US005980210A

United States Patent [19]

Tseng

[11] Patent Number: 5,980,210

[45] Date of Patent: Nov. 9, 1999

[54] DIAPHRAGM-TYPE PRESSURIZING PUMP HAVING A WATER STOPPER STRUCTURE

[76] Inventor: Ho Chiu-Chiung Tseng, 14, Alley 112, Liuh Shang Lane, Nan Yang Road, Feng Yuan City, Taiwan

[21] Appl. No.: 09/055,252

[22] Filed: Apr. 6, 1998

[51] Int. Cl.[6] ..... F04B 49/03

[52] U.S. Cl. ..... 417/38; 417/297

[58] Field of Search ..... 417/38, 44.9, 297, 417/307, 403, 295, 298

[56] References Cited

U.S. PATENT DOCUMENTS

| | | | |
|---|---|---|---|
| 4,995,793 | 2/1991 | Solomon | 417/403 |
| 5,203,803 | 4/1993 | Schoenmeyr | 417/38 |
| 5,261,792 | 11/1993 | Schoenmeyr | 417/38 |
| 5,500,113 | 3/1996 | Hartley et al. | 417/403 |

*Primary Examiner*—Willis R. Wolfe

*Attorney, Agent, or Firm*—Bacon & Thomas

[57] ABSTRACT

A diaphragm-type pressurizing pump having a water stopper structure, in which an upper lid of the pump having a pressurizing room being provided on top of the pressurizing pump, wherein the water stopper structure including mainly a valve body and a valve lid is provided on the upper lid of the pump, a water stopper valve set is provided between the water stopper structure and the upper lid of the pump, wherein communicating water inlet holes are provided on the upper lid of the pump and the valve body and are located on the side of the water inlet, a guide groove having a pressurizing hole is formed on the top of the valve body, a water outlet of the upper lid of the pump is provided with a hole communicating with the pressurizing room, the hole is under the water stopper valve set, the flow between the pressurizing room and the water outlet are blockaded with the water stopper valve set so that the upper lid of the pump has the function of stopping water, and also can save space and save cost.

4 Claims, 4 Drawing Sheets

DIAPHRAGM-TYPE PRESSURIZING PUMP HAVING A WATER STOPPER STRUCTURE

FIELD OF THE INVENTION

The present invention relates to a pressurizing pump for a water filter, particularly to a pressurizing pump that can reduce the assembly room and save assembly cost so as to improve the drawbacks and inconveniences of the conventional pressurizing pump that requires the addition of a water-stopper valve.

BACKGROUND OF THE INVENTION

Conventional reverse osmosis type water filters utilize reverse osmosis tubes for filtering water. The reverse osmosis tubes are very fine and a pressurizing pump is needed to pressurize a water source so that the water can flow smoothly through the reverse tubes. Usually the water is automatically supplied to the reverse osmosis filter and the water source is kept open. A water stopper valve is usually provided after the pressurizing pump so that the water can be stopped from flowing into the reverse osmosis tubes when the water in a water reservoir reaches a predetermined level, and thus water can be saved.

Please refer to FIG. 4 which shows a conventional pressurizing pump and a water stopper valve. The pressurizing pump comprises mainly a pressurizing motor 15 and a pressurizing set 10. An eccentric axle 11 is provided on the bottom of the pressurizing set 10 and operationally connected with the pressurizing motor 15 so that the water source can be pressurized because of this structure. An upper lid 50 of the pump is provided on the upper end of the pressurizing set 10. The upper lid 50 is provided with a pressurizing room 53 and formed with a water inlet hole 51 and a water outlet hole 52 on the two sides thereof. The water outlet hole 52 and the water inlet hole 51 communicate separately with the pressurizing room 53 and are separated with the pressurizing set 10 so that the water can flow from the water inlet hole 51 of the upper lid 50 into the pressurizing set 10, get pressurized in the pressurizing set 10, and flow out from the water outlet hole 52. A water stopper valve 60 is connected after the water outlet hole 52 of the upper lid 50. The water stopper valve 60 has an upper seat 68 and a lower seat 61. The two ends of the upper seat 68 communicate separately with a water source tube. The lower seat 61 is provided with a receiving groove 65 and is formed with a water inlet hole 62 and a water outlet hole 63 on the two ends thereof. The water inlet hole 62 and the water outlet hole 63 are separated with a partition plate 64 and communicate separately with the receiving groove 65 via a communicating hole 620 and a communicating hole 630. a water stopper valve set 66 having a water stopper pad 67 is provided between the lower seat 61 and the upper seat 68. When the water is being pressurized by the pressurizing set 10 of the pressurizing pump, the inlet water pressure of the water inlet hole 62 is larger than the inlet water pressure of the water inlet 69 of the upper seat 68, thus the water stopper pad 67 of the water stopper valve set 66 is pushed upwardly, and the pressurized water can enter the water outlet hole 63 through communicating holes 620 and 630 so that reverse osmosis can be done. On the contrary, when the pressurizing set 10 of the pressurizing pump stop running, the water stopper pad 67 can blockade the flow between the water inlet hole 62 and the water outlet hole 63 because the area above the water stopper pad 67 is larger than the sectional area of the communicating hole 620 of the water inlet hole 62 and because of Pascal's law. Thus the water can be prevented from continuously flowing into reverse osmosis tubes.

In the conventional pump described herein above, the upper lid of the pressurizing pump and the water stopper valve are separated and therefore the pump has relatively more parts and results in higher cost involving molding, manufacturing, and assembling. Furthermore, the total volume of the water filter is relatively large because the pressurizing pump and the water stopper valve are separated, the conventional upper lid of the pressurizing pump is less desirable because of the aforementioned drawbacks.

The inventor of the present invention has many years of experience for the manufacturing, research, and developing the pressurizing pumps of the water filters. The inventor spent a long time to do research and improvement for the pressurizing pumps in order to mitigate the drawbacks of the conventional pumps, and eventually achieves the present invention which has a water stopping structure and which is more compact and of lower cost.

SUMMARY OF THE PRESENT INVENTION

Thus, the principal objective of the present invention is to provide a pressuring pump having a water stopping structure. The pressurizing pump is provided with a water stopper structure formed from a valve body and a valve lid on the top of an upper lid of the pump which has a pressurizing room. A water stopper valve set is provided between the water stopping structure and the upper lid of the pump. A communicating water inlet hole is formed on a side of the upper lid of the pump corresponding to the water inlet of the valve body. A groove communicating with the water inlet hole is formed on the top of the valve body. The guide groove is formed with a pressurizing hole above the valve set. A communicating hole is provided on the upper lid of the pump under the water stopper valve set for connecting the pressurizing room and the water outlet. The cross-sectional area of the pressurizing hole of the valve body is larger than that of the communicating hole land thus the water stopper valve set can downwardly blockade the communicating hole when the pressurizing pump stops running, so as to discontinue the flowing of the water into the water filter and thus the water can be saved.

A preferred embodiment is described hereinbelow with reference to the drawings.

DETAILED DESCRIPTION OF A PREFERRED EMBODIMENT

Figure 1:
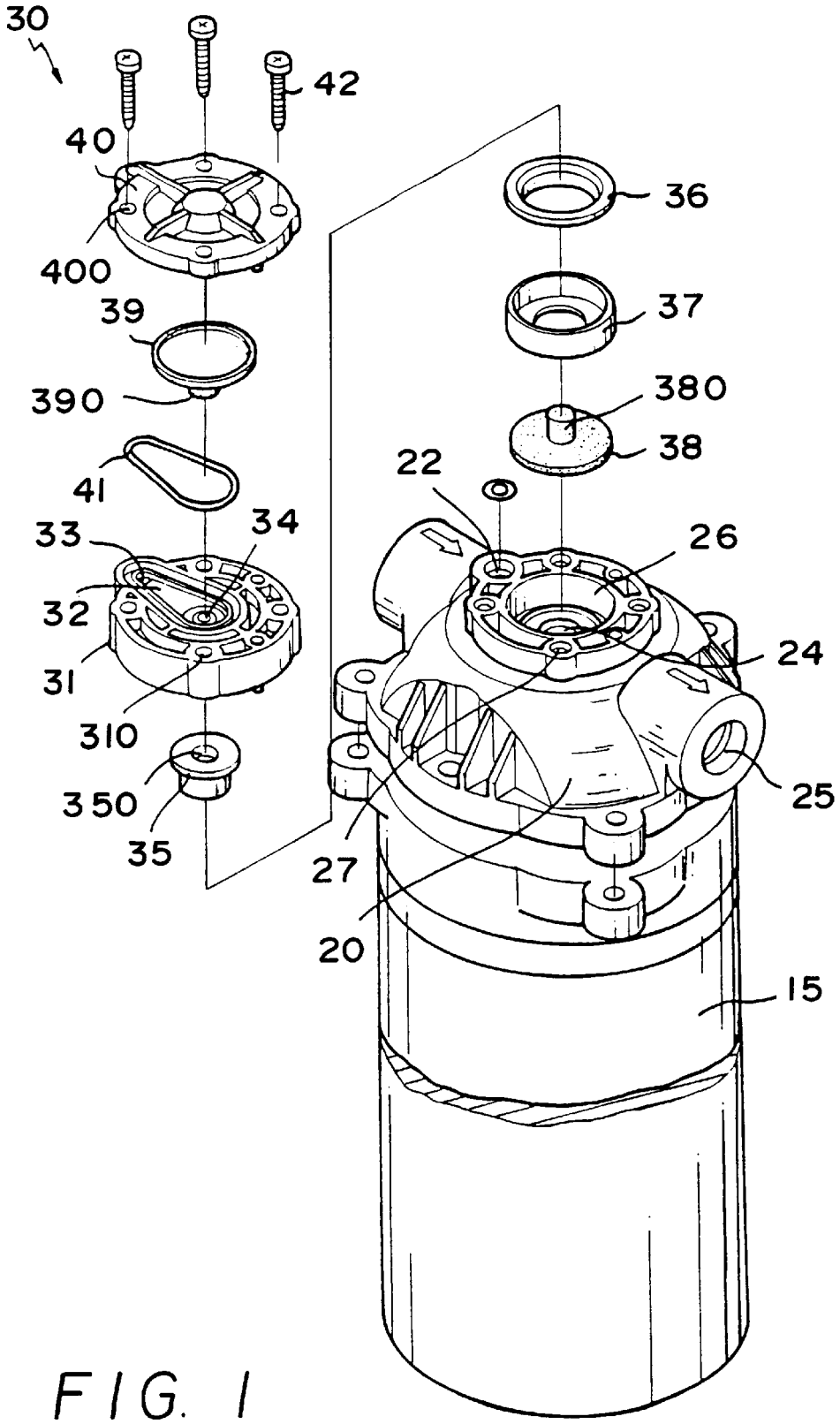
FIG. 1 is an exploded perspective view showing the shapes and the relative positions of the parts of the present invention.

The present invention is a pressurizing pump for a reverse osmosis water filter. Please refer to FIGS. 1 and 2. The pressurizing pump mainly has an upper lid 20 of the pump. A pressurizing room 23 is provided on top of the pressurizing set 10. The pressurizing set 10 is achieved by the driving of an eccentric axle 11 with a motor 15. A water inlet 21 and a water outlet 25 are provided respectively on the two sides of the upper lid 20 of the pump. The pressurizing room 23 on the bottom of the upper lid 20 of the pump communicates separately with the water inlet 21 and the water outlet 25. The pressurizing room 23 is employed for receiving the pressurizing set 10 of the pressurizing pump so as to pressurize the water.

A water stopping structure 30 is provided on top of the upper lid 20 of the pump. A through water inlet hole 22 is formed on one side of the lid 20 close to the water inlet 21. A receiving groove 26 is formed on top of the upper lid 20 of the pump. A through communicating hole 24 is formed between the pressurizing room 23 and the receiving groove 26. An annular communicating hole 250 is formed around the periphery of the communicating hole 24 on the upper lid 20 for communicating the water outlet 25 and the receiving groove 26.

The upper periphery of the upper lid 20 of the pump is provided with a plurality of threaded holes 27 for fastening the water stopper structure 30.

The water stopper structure 30 on top of the upper lid 20 of the pump includes mainly a valve body 31, a valve lid 40 and a water stopper valve set. A through water inlet hole 33 is formed on the valve body 31 at an edge corresponding to the water inlet hole 22 of the upper lid 20 of the pump. A recessed communicating groove 32 is formed on the top of the valve 31. A through pressurizing hole 34 is formed on the center of the valve body 31 for receiving the water stopper valve set. The pressurizing hole 34 has a cross-sectional area larger than the communicating hole 24 of the upper lid 20 of the pump.

The water stopper valve set to be positioned between the pressurizing hole 34 of the valve body 31 and the receiving groove 26 of the upper lid 20 of the pump is a valve stopper 35 which has a positioning hole 350 formed on the top and the bottom sides thereof respectively. The valve stopper 35 is provided with an upper packing seat 36 and a lower packing seat 37 on its outer edge. A water stopper pad 39 and a water stopper 38 of equal diameters are provided above and below the upper packing seat 36 and the lower packing seat 37 respectively. A projecting stud 390 and a projecting stud 380 are provided on the center of the water stopper pad 39 and the water stopper pad 38 and extend toward the positioning holes 350 of the valve stopper 35. Thus the water stopper pads 39 and 38 can be positioned because of the projecting studs 390 and 380 engage the positioning holes 350 of the valve stopper 35. Through holes 310 are provided on the periphery of the valve body 31 and are corresponding to the threaded holes 27 of the upper lid 20 of the pump. A valve lid 40 is provided on top of the val valve body 31.

A seal 41 is provided on the edge of the guide groove 32 between the valve lid 40 and the valve body 31, to prevent the water from leakage. Through holes 400 are provided on the edge of the valve lid 40 and are corresponding to the through holes 310 of the water stopper structure 30, so that bolts 42 can extend therethrough and fasten the relevant parts.

The water stopper valve set is provided in the receiving groove 26 of the upper lid 20 of the pump. The water stopper structure 30 is provided on the upper end of the water stopper valve set, utilizing the pressurizing hole 34.

The water inlet hole 33 of the water stopper structure 30 communicates with the water inlet hole 22 of the upper lid 20 of the pump. Bolts 42 extend through the holes 400 and 310 of the valve lid 40 and the valve body 31 and thread into the threaded hole 27 of the upper lid 20 of the pump so that the water stopper structure 30 can be fastened on top of the upper lid 20 of the pump and form a pressurizing pump having a water stopper structure, as shown in FIG. 3.

Figure 2:
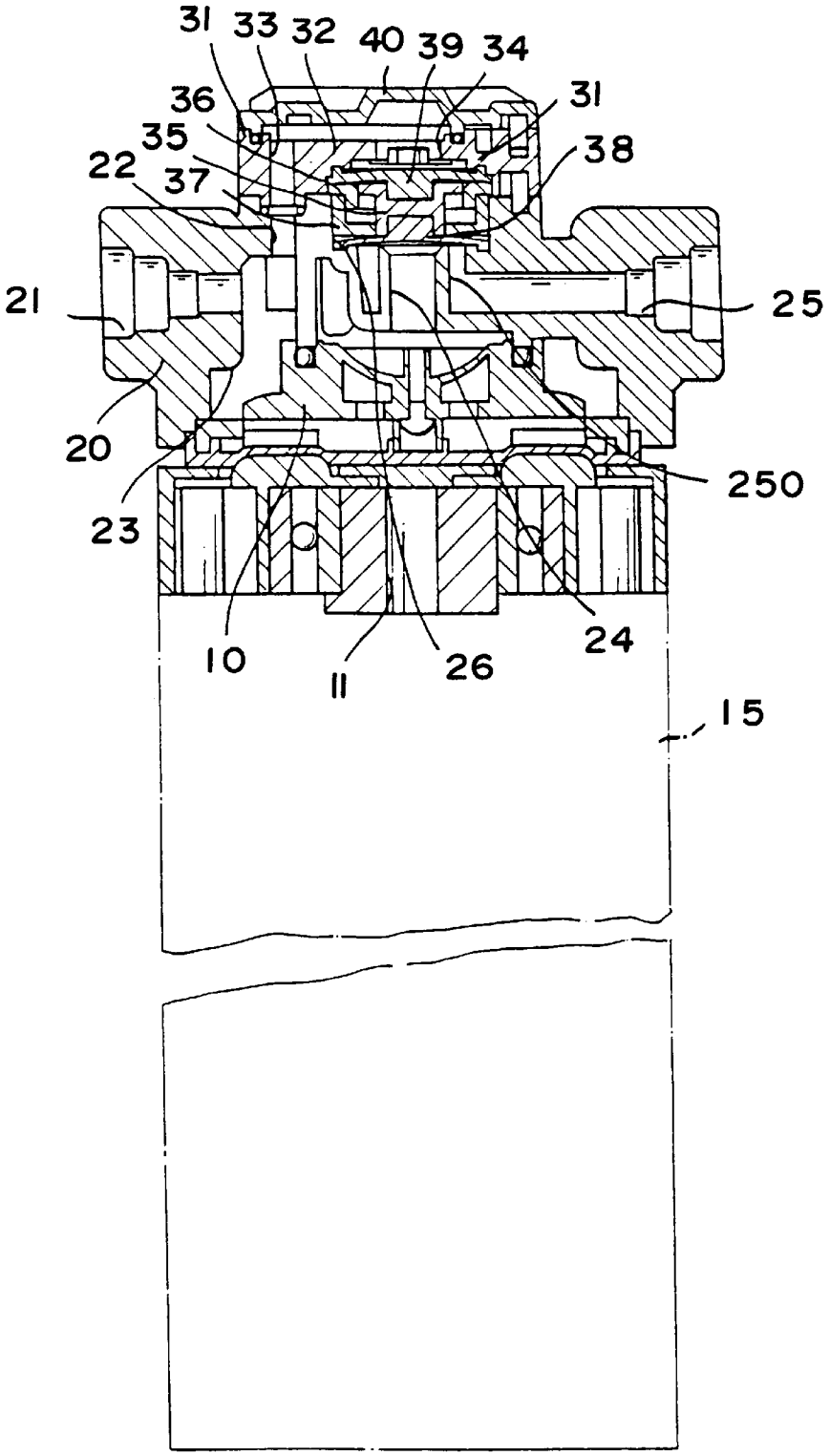
FIG. 2 is a longitudinal sectional view of the present invention in which the water is being pressurized.
Figure 3:
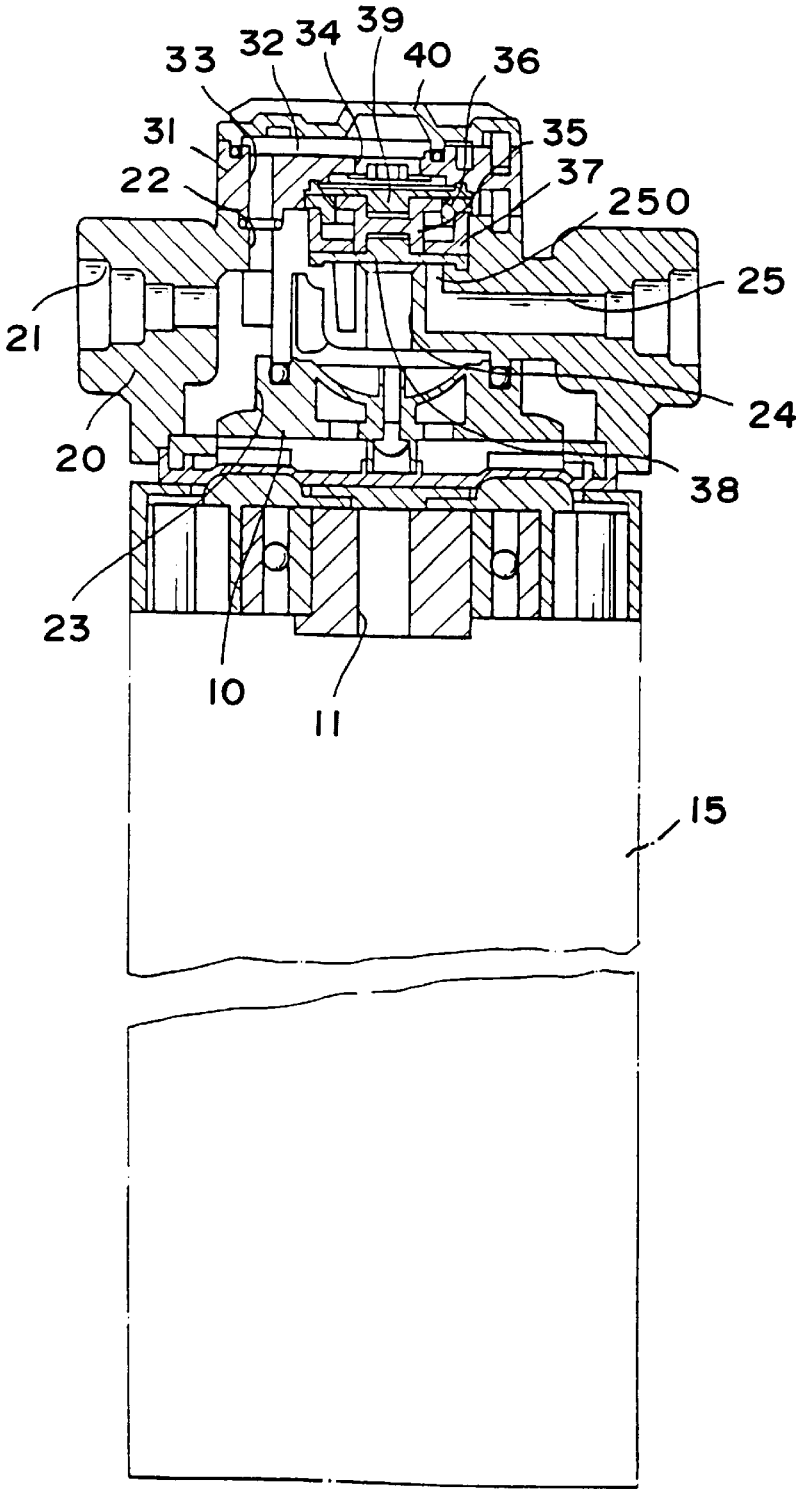
FIG. 3 is another longitudinal sectional view of the present invention in which the water is stopped from flowing into the pump.
Figure 4:
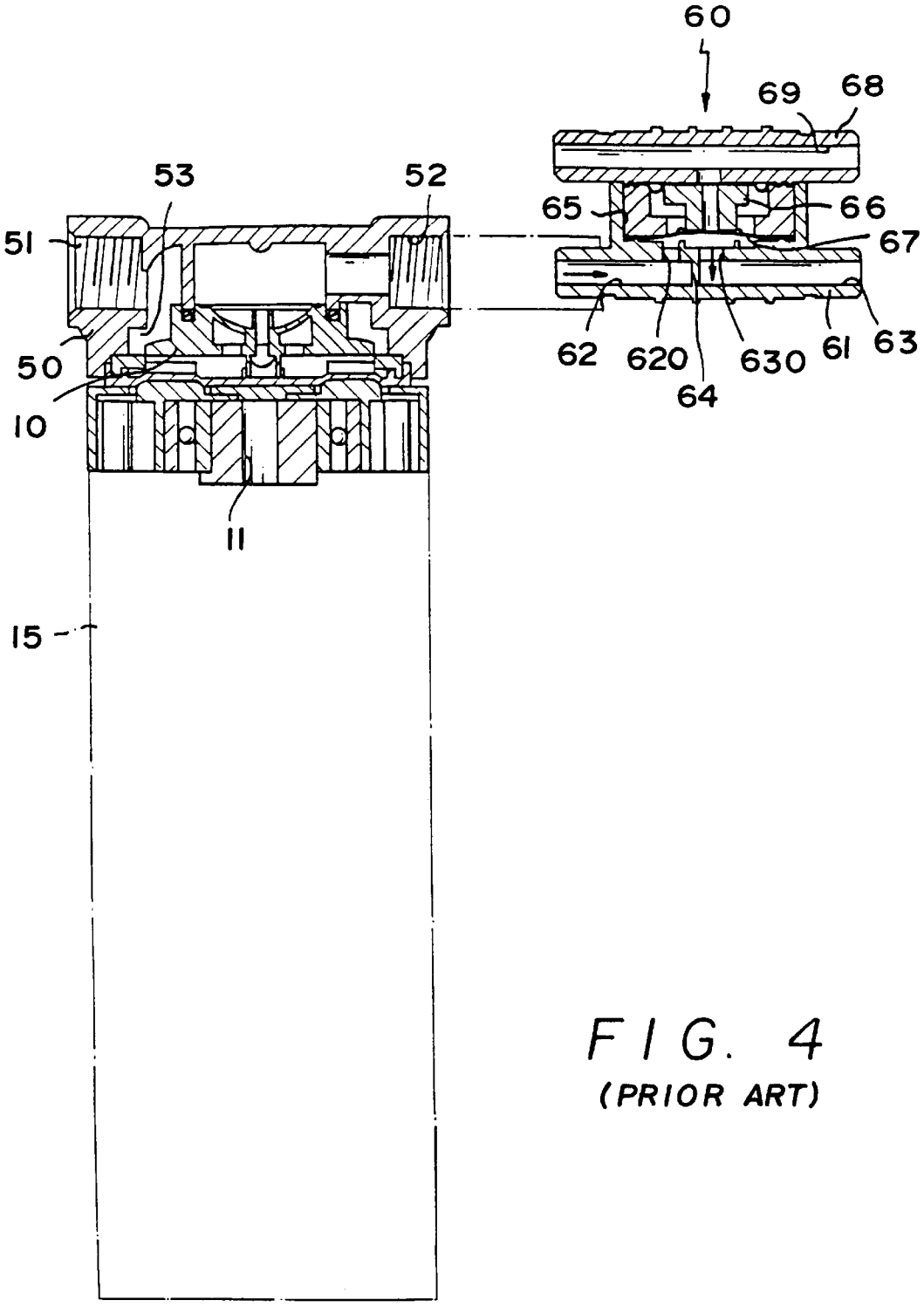
FIG. 4 (PRIOR ART)
FIG. 4 shows a sectional schematic view of a conventional upper lid of the pressurizing pump and a water stopper valve.

The operation of the present invention is shown in FIGS. 2 and 3. When the pressurizing pump on the bottom of the upper lid 20 of the pump begins to operate, the water can be sucked into the water inlet 21 of the upper lid 20 of the pump, pressurized with the eccentric arrangement, and exit through the communicating hole 24 of the upper lid 20 of the pump. At this time, the water pressure at the pressurizing hole 34 above the water stopper valve set in the receiving groove 26 is smaller than the water pressure in the communicating hole 24, thus the water pressured in the communicating hole 24 can push upwardly the water stopper pad 38 of the water stopper valve set and the pressurized water can flow smoothly from the communicating hole 250 and into the water outlet 25 of the upper lid 20 of the pump so as to be treated with the reverse osmosis tubes.

On the contrary, when the pressurizing pump stops running, the water in the communicating hole 24 of the upper lid 20 of the pump restores normal pressure. At this time, a portion of the water flowing in through the water inlet 21 of the upper lid 20 of the pump flows into the guide groove 32 of the valve body 31 through water inlet holes 22 and 33.

The water is introduced into a upper room of the water stopper valve set of the pressurizing hole 34. Because the cross-sectional area of the pressurizing hole 34 is larger than that of the communicating hole 24 and because of the Pascal's Law, the water pressure in the pressurizing hole 34 on top of the water stopper valve set is larger than the water pressure in the communicating hole 24 under the water stopper valve set. Thus the water stopper 38 of the water stopper valve set can blockade the flow between the communicating holes 24 and 250 and the water is prevented from flowing into the water outlet 25 and is thus stopped.

From the description herein above, in the present invention, the water stopper structure is provided on the upper lid of the pump. The water stopper valve set can blockade the communicating hole dues to the Pascal's Law when the pressurizing pump stops running so as to discontinue the flow of the water into the water filter. Therefore the present invention has the following advantages:

1. Saving space: The total space required by the water filter can be saved, compared to the conventional one, because the water stopper structure is directly formed on the top end of the upper lid of the pump;
2. Reducing cost: The total number of the parts can be reduced, compared to the conventional one, because the water stopper structure is provided on the top end of the upper end of the pump, thus the molding, manufacturing and assembling thereof is simplified and of lower cost.

I claim:

1. A diaphragm-type pressurizing pump having a water stopper structure, in which a water inlet and a water outlet are formed on the two sides, respectively, of an upper lid of the pump located on top of the pressurizing pump; a pressurizing room for communicating the water inlet and the water outlet, respectively, is formed on the bottom of the upper lid of the pump; the pressurizing room is for receiving a pressurizing set of the pressurizing pump; characterized in that:

a through water inlet hole being formed upwardly on a side close to the water inlet of the upper lid of the pump; a receiving groove being formed on a top face of the upper lid of the pump; a through communicating hole being formed between the pressurizing room and the receiving groove; an annular communicating hole communicating the water outlet and the receiving groove being forme on the periphery of the communicating hole on the upper lid of the pump;

a water stopper structure being provided on top of the upper lid of the pump; the water stopper structure being comprised of a valve body, a valve lid and a water stopper set; a through water inlet hole being formed on the periphery of the valve body corresponding to the water inlet hole of the upper lid of the pump; a recessed guide groove being formed on top of the valve body; a through pressurizing hole being formed on the center of the valve body; the cross-sectional area of the pressurizing hole being larger than that of the communicating hole of the upper lid of the pump; the water stopper valve set being provided in the pressurizing hole; a valve lid being fastened on the upper end of the valve body;

the water stopper valve set being engaged in the receiving groove of the upper lid of the pump; the pressurizing hole of the valve body being provided on top of the water stopper valve set; the water inlet hole of the valve body being communicating with the water inlet hole of the upper lid of the pump; at least one bolt being used to fastened the valve lid, the valve body, and the upper lid of the pump so as to form a pressurizing pump have a water stopper structure.

2. A pump as defined in claim 1, wherein a plurality of threaded holes are formed on the periphery of the top of the upper lid of the pump, a plurality of threaded holes are also formed on the periphery of the valve body and the valve lid so that the water stopper structure can be fastened to the top of the upper lid of the pump with a plurality of bolts.

3. A pump as defined in claim 1, wherein a seal is provided on the periphery of the guide groove of the valve body so as to prevent the water from leaking.

4. A pump as defined in claim 1, wherein the water stopper valve set includes mainly a water stopper pad having a projecting stud on its bottom face, a valve stopper having an upper positioning hole and a lower positioning hole, another water stopper pad having a projecting stud on its upper face, and an upper packing seat and a lower packing seat on the outer edge of the valve stopper.

* * * * *